US006010302A

United States Patent [19]

Oeynhausen

[11] Patent Number: 6,010,302

[45] Date of Patent: Jan. 4, 2000

[54] TURBINE SHAFT OF A STEAM TURBINE WITH INTERNAL COOLING AND METHOD FOR COOLING A TURBINE SHAFT OF A STEAM TURBINE

[75] Inventor: Heinrich Oeynhausen, Mülheim, Germany

[73] Assignee: Siemens Aktiengesellschaft, Munich, Germany

[21] Appl. No.: 09/114,737

[22] Filed: Jul. 13, 1998

Related U.S. Application Data

[63] Continuation of application No. PCT/DE96/02490, Dec. 20, 1996.

[30] Foreign Application Priority Data

Jan. 11, 1996 [DE] Germany ..... 196 00 821

[51] Int. Cl.[7] ..... F01D 5/08

[52] U.S. Cl. ..... 415/115; 415/114; 415/116; 415/176; 415/180

[58] Field of Search ..... 415/114, 115, 415/116, 176, 180; 416/95, 96 R, 97 R; 60/39.75

[56] References Cited

U.S. PATENT DOCUMENTS

| | | | |
|---|---|---|---|
| 3,189,320 | 6/1965 | Beldecos et al. . | |
| 4,551,063 | 11/1985 | Raschke et al. | 415/115 |
| 4,571,935 | 2/1986 | Rice | 60/39.05 |
| 5,498,131 | 3/1996 | Minto | 415/216.1 |

FOREIGN PATENT DOCUMENTS

| | | |
|---|---|---|
| 358337 | 9/1980 | Australia . |
| 527127 | 4/1929 | Germany . |
| 959868 | 9/1956 | Germany . |
| 4324034 | 1/1995 | Germany . |
| 4411616 | 10/1995 | Germany . |
| 801689 | 9/1958 | United Kingdom . |
| 809268 | 2/1959 | United Kingdom . |

OTHER PUBLICATIONS

Japanese Patent Abstract No. 59034402 (Kuniyoshi et al.), dated Feb. 24, 1984.

*Primary Examiner*—Edward K. Look
*Assistant Examiner*—Ninh H. Nguyen
*Attorney, Agent, or Firm*—Herbert L. Lerner; Laurence A. Greenberg

[57] ABSTRACT

A turbine shaft, in particular for a combined high-pressure/intermediate-pressure steam turbine accommodated in a common casing and a method of cooling a turbine shaft of a steam turbine. The turbine shaft has a cooling line in its interior for guiding cooling steam. The cooling line is connected on one side to an outflow line and on the other side to an inflow line. Steam cooling of the turbine shaft of a combined high-pressure/intermediate-pressure steam turbine can thereby be achieved by feeding steam from the high-pressure part through the inflow line to the intermediate-pressure part and through the outflow line.

19 Claims, 2 Drawing Sheets

TURBINE SHAFT OF A STEAM TURBINE WITH INTERNAL COOLING AND METHOD FOR COOLING A TURBINE SHAFT OF A STEAM TURBINE

CROSS-REFERENCE TO RELATED APPLICATION

This application is a continuation of copending International Application No. PCT/DE96/02490, filed on Dec. 20, 1996, which designated the United States.

BACKGROUND OF THE INVENTION

Field of the Invention

The invention relates to a turbine shaft of a steam turbine, in particular for the combined accommodation of high-pressure and intermediate-pressure blading. The invention also relates to a method of cooling a turbine shaft of a steam turbine.

The use of steam at relatively high pressures and temperatures helps to increase the efficiency of a steam turbine. In addition, the use of steam in such a steam state makes increased demands on the corresponding steam turbine. A combined high-pressure and intermediate-pressure turbine is suitable in the case of a steam turbine of the lower to medium power rating, for example from 300 MW up to 600 MW. In that case, both high-pressure moving blades and intermediate-pressure moving blades are accommodated by the turbine shaft. The turbine shaft is accommodated in a single casing which has the allocated guide blades. An advantage of a steam turbine in which the high-pressure and intermediate-pressure blading are disposed in a common casing is, for example, that despite a more complicated type of construction, there is a shorter overall length and no bearing is needed. The common casing may have an inner casing and an outer casing which in each case are split horizontally and bolted to one another. The live steam state characterized by the high-pressure steam can at present be around 170 bar and 540° C. In connection with the increase in efficiency, a live-steam state of 270 bar and 600° C. may be aimed for. The high-pressure steam can be fed in a middle region of the turbine shaft to the high-pressure blading and flows through the latter up to an exhaust connection. The steam which is thus expanded and cooled down may be fed to a boiler and heated up there again. The steam state at the end of the high-pressure part is referred to below as cold reheating and the steam state after leaving the boiler is referred to as hot reheating. The steam coming out of the boiler is fed to the intermediate-pressure blading. The steam state can be around 30 bar to 50 bar and 540° C., in which case an increase to a steam state of about 50 bar to 60 bar and 600° C. is aimed at. Further investigations would be required to determine the extent to which the materials used heretofore for manufacturing corresponding turbine shafts and turbine casings, in particular a chromium steel having 9% to 12% by weight of chromium, can meet the requirements at relatively high steam states. The moving blades in the steam-admission region of both the high-pressure part and the intermediate-pressure part may be manufactured from a nickel-based alloy. Furthermore, structural measures in which the turbine shaft is protected by shaft shields from direct contact with the steam may be carried out in the steam-admission region.

Published Japanese Patent Application 59 034 402 relates to a steam turbine with a hollow turbine shaft. Steam which flows into the turbine shaft serves to drive the turbine. The steam turbine is formed of a single partial turbine, in the middle region of which steam which is already partly expanded flows into the interior of the turbine shaft. The steam which flows at that location is divided by a throttle into two streams, namely into a cold partial flow which is conducted in the direction of the steam-admission region, and a hot partial flow which is conducted in the direction of the exhaust steam region.

SUMMARY OF THE INVENTION

It is accordingly an object of the invention to provide a turbine shaft of a steam turbine with internal cooling and a method for cooling a turbine shaft of a steam turbine, which overcome the hereinafore-mentioned disadvantages of the heretofore-known devices and methods of this general type, in such a way that the turbine shaft withstands particularly locally occurring high operational thermal loads in a stable manner over a long period.

With the foregoing and other objects in view there is provided, in accordance with the invention, a turbine shaft of a steam turbine, comprising a rotation turbine shaft axis; a jacket surface having recesses formed therein for receiving moving turbine blades; an interior; a cooling line for guiding cooling steam in the direction of the rotation axis, the cooling line disposed in the interior and having ends; at least one outflow line connected to one of the ends and leading into at least one of the recesses for guiding cooling steam to the jacket surface; and at least one inflow line connected to the other of the ends for an inflow of the cooling steam into the cooling line.

With the objects of the invention in view there is also provided, in a combined high-pressure/intermediate-pressure steam turbine having high-pressure moving blades, and having intermediate-pressure moving blades with a steam-admission region, a turbine shaft for accommodating the high-pressure and intermediate-pressure moving blades, comprising a rotation turbine shaft axis; a jacket surface; an interior; a cooling line for guiding cooling steam in the direction of the rotation axis, the cooling line disposed in the interior and having ends; at least one outflow line connected to one of the ends and leading to the jacket surface in the steam-admission region for guiding cooling steam to the jacket surface; and at least one inflow line connected to the other of the ends for an inflow of the cooling steam into the cooling line. The jacket surface of such a turbine shaft may have recesses formed therein for receiving moving turbine blades, and the at least one outflow line may lead into at least one of the recesses.

The cooling line running in the interior of the turbine shaft permits cooling steam to be directed in the direction of the rotation axis through the turbine shaft and to be carried through the outflow line to the jacket surface, so that the turbine shaft can be cooled both in its interior and at the jacket surface in areas subjected to high thermal loads. The cooling line may run in an inclined or helical manner relative to the rotation axis, in which configuration it permits a transport of cooling steam in the direction of the rotation axis. Furthermore, cooling of the moving blades, which can be anchored in the turbine shaft, in particular cooling of their roots, can also be carried out. It goes without saying that, depending on the manufacture of the cooling line, the outflow line and the inflow line may constitute part of the cooling line. Furthermore, it goes without saying that more than one cooling line may be provided, in which case the cooling lines are connected to one another and may in each case be connected to one or more outflow lines or inflow lines. It is likewise possible to place outflow lines, which are adjacent in the direction of the rotation axis, at predeterminable distances apart and to connect them to the cooling line. Cooling of shaft sections subjected to high thermal loads can therefore be carried out without a considerable outlay for pipework, casing leadthroughs and integration in the turbine control system. This high structural outlay would be necessary, for example, when cooling a turbine shaft through the use of cold steam from outside through the casing and the guide blades up to the turbine shaft in order to cool the jacket surface of the turbine shaft directly.

The turbine shaft according to the invention is especially suitable for the development of a combined high-pressure and intermediate-pressure turbine shaft for a steam turbine, especially since the steam-admission region of the intermediate-pressure part of a steam turbine is a critical point in the turbine structure. Significantly higher volumetric flows and thus larger shaft diameters and longer blades are necessary in the intermediate-pressure part as compared with the high-pressure part, as a result of lower steam pressures. Therefore, the thermomechanical stress on the moving blade roots and on the shaft in the intermediate pressure part is greater than in the high-pressure part. In addition, since similar temperatures prevail in the high-pressure part and in the intermediate-pressure part, the material characteristics of the turbine shaft, such as creep strength and notched-bar impact strength for example, are likewise similar. As a result thereof, due to the higher thermo-mechanincal loads on the intermediate-pressure part, it has to be rated as more critical than the high-pressure part. This problem is solved by the turbine shaft according to the invention in that the turbine shaft in the intermediate-pressure part can be cooled by cooling steam both in its interior, in particular in the shaft center, and at its jacket surface, especially in the area of the moving-blade roots. The cooling steam is preferably directed from the high-pressure part through the cooling line into the intermediate-pressure part, with the flow of the steam being effected by the pressure difference between the high-pressure part and the intermediate-pressure part. This pressure difference, for example between the steam-outlet region of the high-pressure part and the steam-admission region of the intermediate-pressure part, is between 4 bar and 6 bar. The steam flow can be regulated by appropriate dimensioning of the cross-section of the cooling line in such a way that sufficient cooling capacity is ensured even over a wide power range of the steam turbine.

In accordance with another feature of the invention, the cooling line is a bore which is largely parallel to the rotation axis and is in particular a central bore. A cooling line constructed as a bore can even be made subsequently in the turbine shaft in an especially simple and precise manner.

In accordance with a further feature of the invention, the bore is closed downstream of the connecting point to the outflow line, in particular by a plug. This ensures that cooling steam flowing in through the inflow line can be passed completely through the outflow line and out of the turbine shaft again. In a combined high-pressure/intermediate-pressure turbine, the outflow line or outflow lines lie near the moving blades of the steam-admission region of the intermediate-pressure part, as a result of which cooling, in particular of the blade roots, of these moving blades that are subjected especially to thermal loads is ensured.

In accordance with an added feature of the invention, like the outflow line, the inflow line connects the jacket surface to the cooling line. In this way, cooling steam, in particular steam of a steam turbine, can be directed from the jacket surface at one end of the turbine shaft through the interior of the turbine shaft into the middle region of the turbine shaft. This is especially advantageous in a combined high-pressure and intermediate-pressure turbine shaft, since steam can thus be directed from the seam-exhaust region of the high-pressure part into the steam-admission region of the intermediate-pressure part.

In accordance with an additional feature of the invention, the inflow line and/or the outflow line is an essentially radial bore. Such a bore is simple to make even after the turbine shaft is manufactured, in which case such a bore can be connected precisely to a cooling line constructed as an axial bore. The diameter of a bore and the number of several bores for the inflow line and the outflow line depend on the steam quantity provided for the cooling.

In accordance with yet another feature of the invention, the outflow line leads out into one of the recesses at the jacket surface for accommodating moving turbine blades. In this case, the recesses may be made slightly larger than the roots of the respective moving blades so that a space is formed between a corresponding root and the turbine shaft, into which space steam can flow for cooling the moving-blade root. This space may also be formed by passages which are connected to the outflow line and/or to one another.

In accordance with yet a further feature of the invention, there is provided a branch line leading from a recess, into which an outflow line leads, to the jacket surface of the turbine shaft. In this way, apart from cooling of the blade roots, cooling of the jacket surface and thus of the turbine shaft from outside is also achieved. This is specially advantageous in the steam-admission region of the intermediate-pressure part of a combined high-pressure/intermediate-pressure turbine shaft. The turbine shaft is thereby cooled from the interior in the region of the high-pressure part, in the region of a shaft seal lying between the high-pressure part, in the region of a shaft seal lying between the high-pressure part and the intermediate-pressure part, as well as in the especially stressed steam-admission region of the intermediate-pressure part including the blade roots of the first row of moving blades of the intermediate-pressure part. The turbine shaft is therefore preferably suitable for a steam turbine in which the high-pressure part and the intermediate-pressure part are accommodated in a common casing. The outflow line leads out in the steam-admission region of the intermediate-pressure moving blades so that cooling of both the turbine shaft and the moving blades including the moving blade roots is effected in this region. The inflow line preferably connects the seam-exhaust region of the high-pressure moving blades to the cooling line as a result of which steam can be directed form the steam-outlet region of the high-pressure part through the interior of the turbine shaft into the intermediate-pressure part.

With the objects of the invention in view there is also provided a method for cooling a turbine shaft of a steam turbine, which comprises providing a turbine shaft with an interior, high-pressure moving blades having a steam region and intermediate-pressure moving blades having a steam-admission region; and directing steam from the steam region through the interior to the steam-admission region.

In this case, the steam flow in the interior of the turbine shaft can be regulated by suitable dimensioning of a corresponding cooling line, which is provided in particular as a bore, in such a way that sufficient cooling is ensured even over a wide power range.

Since there is a pressure difference between the high-pressure part and the intermediate-pressure part even in the partial-load range of the steam turbine, satisfactory operability of the method even in the partial-load range is ensured. Due to a cooling provided as an axial, preferably central, bore, the tangential stresses in the interior of the turbine shaft may possibly increase to about twice the size, as compared with a turbine shaft without a bore. However, this higher stress possibly acting on the turbine shaft is compensated again by the distinctly improved material properties due to the internal cooling of the turbine shaft.

Other features which are considered as characteristic for the invention are set forth in the appended claims.

Although the invention is illustrated and described herein as embodied in a turbine shaft of a steam turbine with internal cooling and a method for cooling a turbine shaft of a steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
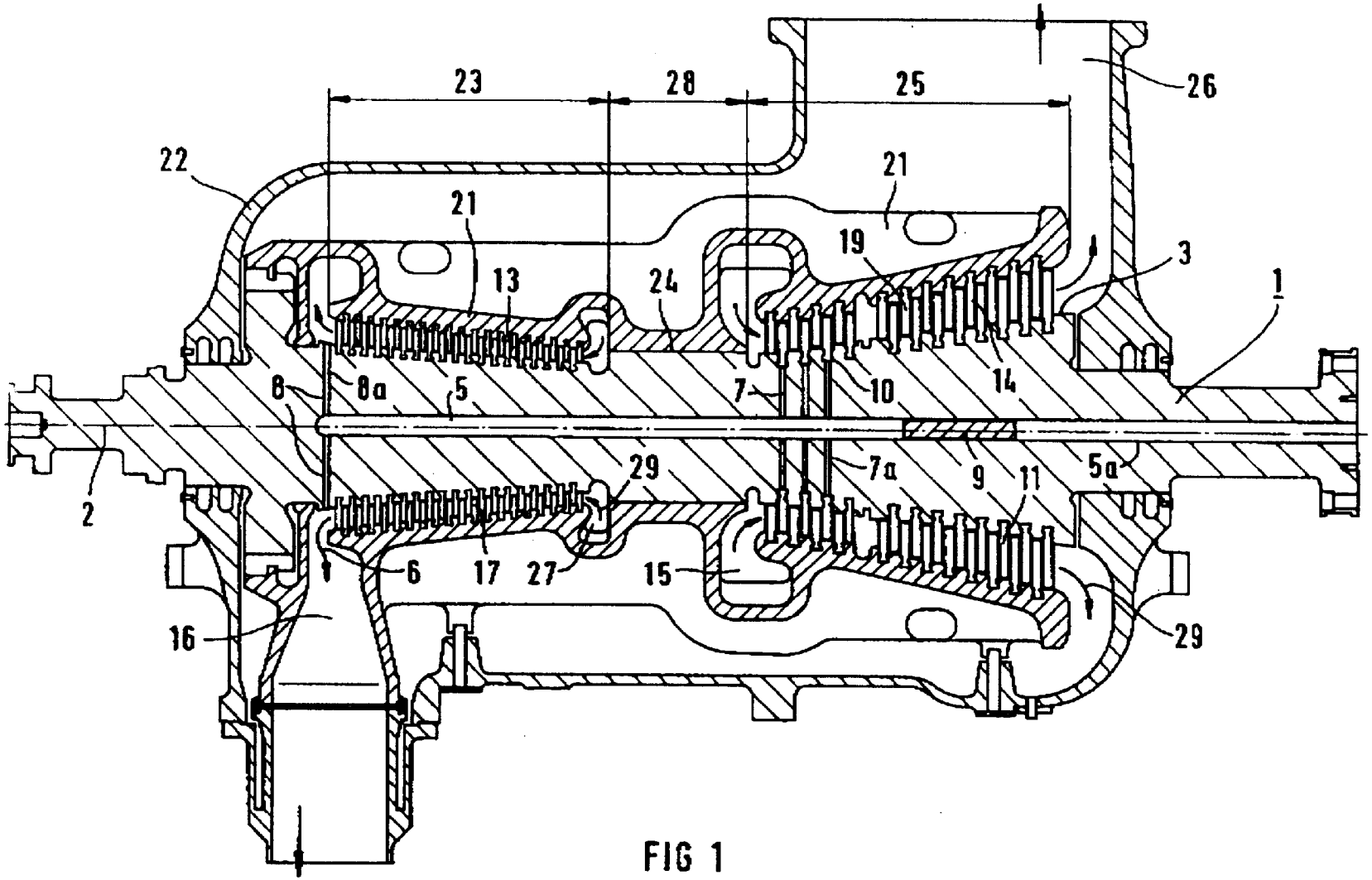
FIG. 1 is a diagrammatic, longitudinal-sectional view of a combined high-pressure/intermediate-pressure turbine in a casing with a turbine shaft.

Referring now to the figures of the drawings in detail and first, particularly, to FIG. 1 thereof, there is seen a turbine shaft 1 which extends along a rotation axis 2 and is disposed in an outer casing 22 enclosing an inner casing 21. The turbine shaft 1 has a middle region 28. The middle region 28 and the inner casing 21 together contain a shaft seal 24. According to FIG. 1, a high-pressure part 23 of the steam turbine adjoins the middle region 28 on the left. An intermediate-pressure part 25 of the steam turbine lies to the right of the middle region 28. The high-pressure part 23 has high-pressure blading 13 and a high-pressure steam admission region 27 which directly adjoins the shaft seal 24. Inflowing high-pressure steam flows from the high-pressure steam admission region 27 through a steam region 17 of the high-pressure blading 13 and leaves the outer casing 22 through a steam-outlet region 16 to a non-illustrated boiler in which reheating takes place. Reheated steam 6 passes back into the outer casing 22 and the inner casing 21 through a steam-admission region 15 of the intermediate-pressure part 25, which adjoins the shaft seal 24 directly to the right of the same. The reheated steam 6 flows through intermediate-pressure blading 14 adjoining the steam-admission region 15 of the intermediate-pressure part 25 on the right. The steam 6 can be directed through an outflow connection 26 adjoining the intermediate-pressure blading 14 to a non-illustrated low-pressure steam turbine. The flow of the steam 6 described above is identified by flow arrows 29.

The turbine shaft 1 has a central bore 5*a* which coincides with the rotation axis 2 and extends through the intermediate-pressure part 25 and right through the high-pressure part 23. The central bore 5*a* is connected to a jacket or circumferential surface 3 of the turbine shaft 1 by a plurality of inflow lines 8 in the steam-outlet region 16 of the high-pressure part 23. The inflow lines 8 are provided as radial bores 8*a*, permitting "cold" steam to flow out of the high-pressure part 23 into the central bore 5*a*. Furthermore, the central bore 5*a* is connected to a plurality of outflow lines 7 in the intermediate-pressure part 25 in a region of first rows of moving blades. These outflow lines 7 in each case extend from recesses 10 in the jacket surface 3 for accommodating moving blades 11 to the central bore 5*a*. The outflow lines 7 are likewise essentially running bores 7*a*. The central bore 5*a* is tightly closed downstream of the outflow lines 7 by a plug 9. A part of the bore 5*a* lying between the outflow lines 7 and the inflow lines 8 therefore forms a cooling line 5 through which the steam 6 flows from the high-pressure part 23 into the steam-admission region 15 of the intermediate-pressure part 25. This steam 6 has a distinctly lower temperature than the reheated steam flowing into the steam-admission region 15, so that effective cooling of the first rows of moving blades of the intermediate-pressure part 25 as well as of the jacket surface 3 in the region of these rows of moving blades is ensured.

Figure 2:
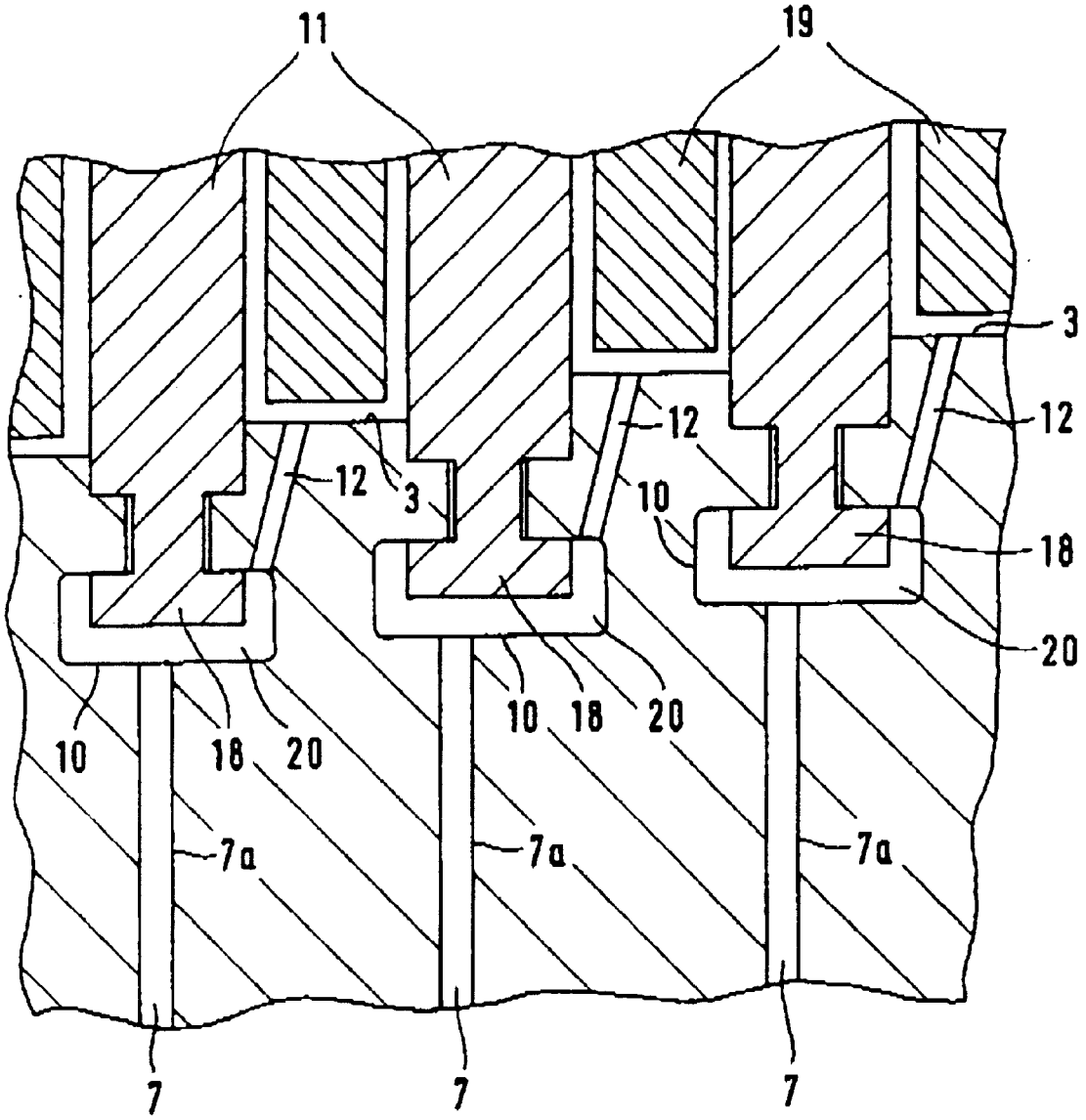
FIG. 2 is an enlarged, fragmentary, longitudinal-sectional view of the turbine shaft in a steam-admission region of the intermediate-pressure part.

FIG. 2 shows the steam-admission region 15 of the intermediate-pressure part 25 on an enlarged scale. In each case corresponding moving blades 11 are disposed with their blade roots 18 in the recesses 10 of the turbine shaft 1. The recesses 10 in each case have passages 20 around the blade roots 18. In each case the passages 20 are connected on one hand to the outflow lines 7 running radially relative to the rotation axis 2 and on the other hand to a branch line 12. The branch line 12 leads from the recess 10 to the jacket surface 3 so that the branch line 12 is opposite a guide blade 19 of the steam turbine. The steam 6 flowing out of the high-pressure part 23 through the outflow lines 7 passes into the passages 20 of the recesses 10 and thus cools the blade roots 18 which are each disposed in a corresponding recess 10. The steam 6 flows from the passages 20 through a respective branch line 12 to the jacket surface 3 of the turbine shaft 1 and thus also cools the jacket surface 3 between the moving blades 11 adjacent one another in the direction of the rotation axis 2.

The invention is distinguished by a turbine shaft which carries both the moving blades of a high-pressure part and the moving blades of an intermediate-pressure part of a steam turbine. The turbine shaft has at least one cooling line which is connected through at least one inflow line to the high-pressure part and at least through one outflow line to the steam-admission region of the intermediate-pressure part. The inflow line, the cooling line and the outflow line form a line system in the interior of the turbine shaft. The "cold steam" can be directed through the line system from the high-pressure part to the thermomechanically highly stressed steam-admission region of the intermediate-pressure part. In this way, both the moving blades, in particular the moving blade roots, and the surface of the turbine shaft in the especially highly stressed steam-admission region of the intermediate-pressure part, are cooled without a costly structure.

I claim:

1. A turbine shaft of a steam turbine, comprising:

a rotation turbine shaft axis;

a jacket surface having recesses formed therein for receiving moving turbine blades;

an interior;

a cooling line for guiding cooling steam in the direction of said rotation axis, said cooling line disposed in said interior and having ends;

at least one outflow line connected to one of said ends and leading into at least one of said recesses for guiding cooling steam to said jacket surface; and at least one inflow line connected to the other of said ends for an inflow of the cooling steam into said cooling line.

2. The turbine shaft according to claim 1, wherein said cooling line is a bore substantially parallel to said rotation axis.

3. The turbine shaft according to claim 1, wherein said cooling line is a central bore.

4. The turbine shaft according to claim 2, wherein said bore is closed downstream of said at least one outflow line.

5. The turbine shaft according to claim 2, including a plug closing said bore downstream of said at least one outflow line.

6. The turbine shaft according to claim 1, wherein said at least one inflow line extends from said jacket surface to said cooling line.

7. The turbine shaft according to claim 1, wherein at least one of said at least one inflow line and said at least one outflow line is an essentially radial bore.

8. The turbine shaft according to claim 1, including branch lines connecting said recesses to said jacket surface.

9. In a combined high-pressure/intermediate-pressure steam turbine having high-pressure moving blades, and having intermediate-pressure moving blades with a steam-admission region, a turbine shaft for accommodating the high-pressure and intermediate-pressure moving blades, comprising:

a rotation turbine shaft axis;

a jacket surface;

an interior;

a cooling line for guiding cooling steam in the direction of said rotation axis, said cooling line disposed in said interior and having ends;

at least one outflow line connected to one of said ends and leading to said jacket surface in the steam-admission region for guiding cooling steam to said jacket surface; and at least one inflow line connected to the other of said ends for an inflow of the cooling steam into said cooling line.

10. The turbine shaft according to claim 9, wherein said jacket surface has recesses formed therein for receiving moving turbine blades, said at least one outflow line leading into at least one of said recesses.

11. The turbine shaft according to claim 9, wherein said cooling line is a bore substantially parallel to said rotation axis.

12. The turbine shaft according to claim 9, wherein said cooling line is a central bore.

13. The turbine shaft according to claim 11, wherein said bore is closed downstream of said at least one outflow line.

14. The turbine shaft according to claim 11, including a plug closing said bore downstream of said at least one outflow line.

15. The turbine shaft according to claim 9, wherein said at least one inflow line extends from said jacket surface to said cooling line.

16. The turbine shaft according to claim 9, wherein at least one of said at least one inflow line and said at least one outflow line is an essentially radial bore.

17. The turbine shaft according to claim 9, including branch lines connecting said recesses to said jacket surface.

18. The turbine shaft according to claim 9, wherein said at least one inflow line opens into a steam-outlet region of the high-pressure moving blades.

19. A method for cooling a turbine shaft of a steam turbine, which comprises:

providing a turbine shaft with an interior, high-pressure moving blades having a steam region and intermediate-pressure moving blades having a steam-admission region; and directing steam from the steam region through the interior to the steam-admission region.

* * * * *